US005996603A

United States Patent [19]

Dupler

[11] Patent Number: 5,996,603

[45] **Date of Patent: *Dec. 7, 1999**

[54] APPARATUS AND METHOD FOR AN IN-LINE VALVE-CONTROLLABLE OUTLET

[76] Inventor: Marion Dale Dupler, 718 Roundtree, Mesquite, Tex. 75150

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,318

[22] Filed: Mar. 21, 1996

[51] Int. Cl.[6] ..... F16K 11/02

[52] U.S. Cl. ..... 137/1; 137/360; 137/597

[58] Field of Search ..... 137/360, 597, 137/1

[56] References Cited

U.S. PATENT DOCUMENTS

| | | | |
|---|---|---|---|
| 1,787,947 | 1/1931 | Lehnert | 137/597 |
| 2,725,894 | 12/1955 | Mamoli | 137/360 |
| 2,954,798 | 10/1960 | Mustee | 137/597 |
| 3,234,958 | 2/1966 | Butters et al. | 137/360 |
| 3,329,162 | 7/1967 | Sanford | 137/597 |
| 4,158,471 | 6/1979 | Logsdon | 137/360 X |
| 4,580,600 | 4/1986 | Mazzei et al. | 137/597 |
| 4,637,422 | 1/1987 | Izzi, Sr. et al. | 137/360 |
| 4,716,925 | 1/1988 | Prather | 137/360 |
| 4,826,207 | 5/1989 | Humpert | 137/360 |
| 5,010,924 | 4/1991 | Jenn | 137/597 |

*Primary Examiner*—Stephen M. Hepperle

[57] ABSTRACT

An in-line valve-controllable outlet for an in-line connection between a washing machine water supply and a washing machine. The valve-controllable outlet has a first conduit with a first diversionary port positioned between an input port and an output port, the input port for connection to the hot water source and the output port for connection to the hot water inlet of the washing machine and a second conduit having a second diversionary port positioned between an input port and an output port, the input port for connection to the cold water source and the output port for connection to the cold water inlet of the washing machine. A mixing valve receives each of the first and the second diversionary port. An output port of the mixing valve discharges the mixed water.

12 Claims, 3 Drawing Sheets

APPARATUS AND METHOD FOR AN IN-LINE VALVE-CONTROLLABLE OUTLET

TECHNICAL FIELD

The invention relates to an valve assembly connectable in-line in fluid communication between a washing-machine water supply and a washing machine for providing a mixed-water source while maintaining a water-supply connection to the washing machine.

BACKGROUND OF THE INVENTION

When household chores need to be performed, such as washing pets or cars, a warm of temperate water supply is needed. For example, in the winter months, temperate water is needed to wash a dog to loosen the natural oils accumulated in the animal's fur. Temperate water is also needed to wash the oil-based residues that accumulate on the surface of a car or its engine. Outside water faucets would be unavailable to supply this need as they would provide cold water. Hot water faucets are similarly unavailable as the hot water would typically scald the animal, or if used to de-ice a windshield, risk cracking the windshield because of the sudden temperature differential. Other uses and needs for temperate water can be realized.

Conventionally, temperate water would have to be supplied from inside a house using buckets or the like. While being carried outside, the water would typically spill or splatter, creating a mess to clean. Furthermore, the quantity that could be carried is insufficient to complete the job, requiring multiple trips for water.

Temperate water sources could also be supplied by modifying a buildings existing water lines by tapping into existing hot- and cold-water lines and connecting a mixing valve to the taps. Such modifications are expensive because a plumber must cut into existing walls to find the water pipes, make the modifications, and repair the damage to the walls.

A need exists for a device which provides an adjustable temperate-water source on demand without reconnections or modification of existing water lines.

SUMMARY OF THE INVENTION

An in-line valve-controllable outlet for an in-line connection between a washing machine water supply and a washing machine. The outlet has a first conduit having a first diversionary port positioned between an input port and an output port. The input port of the first conduit is connectable to the hot water source and the output port of the first conduit is connectable to the hot water inlet. When connected, fluid communication is established to the first diversionary port.

The outlet has a second conduit having a second diversionary port positioned betwen an input port and an output port. The input port of the second conduit is connectable to the cold water source and the output port of the first conduit is connectable to the cold water inlet. When connected, fluid communication is established to the second diversionary port.

A mixing valve receives each of the first and the second diversionary ports. An output, or discharge, port discharges a mixed fluid from the mixing valve.

These and other features and advantages of the present invention will be apparent to those skilled in the art upon reading the following detailed description or preferred embodiments and referring to the drawing.

BRIEF DESCRIPTION OF THE DRAWING

The accompanying drawing is incorporated into and forms a part of the specification to illustrate several examples of the present invention. The figures of the drawing together with the description serve to explain the principles of the invention. The drawing is only for the purpose of illustrating preferred and alternative examples of how the invention can be made and used and is not to be construed as limiting the invention to only the illustrated and described examples. The various advantages and features of the present invention will be apparent from a consideration of the drawing in which.

Numeral references are employed to designate like parts throughout the various figures of the drawing.

DESCRIPTION OF A PREFERRED EMBODIMENT

Figure 1:
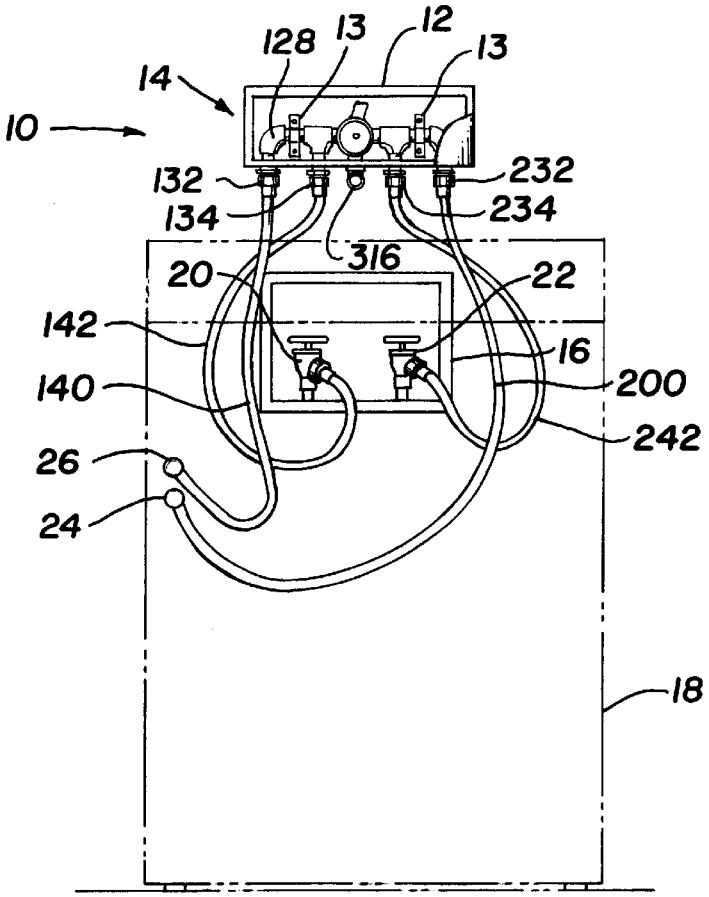
FIG. 1 is an illustration of the invention mounted on a support wall and in fluid communication with a washing machine water supply having hot and cold lines and a washing machine having a hot water inlet and a cold water inlet.

Referring to FIG. 1, an in-line valve-controllable outlet unit is shown generally designated by the numeral 10. As shown, outlet unit 10 is connected in-line between washing machine water source 16 and washing machine 18. Washing machine is illustrated in phantom lines. Washing machine water source 16 is of a conventional design built into modern residences. Washing machine 18 has a hot-water inlet 24 and a cold water-inlet 26. Water source 16 has a hot-water faucet 20 and a cold-water faucet 22 having thread adapters for connecting to hoses. These supplies are conventionally connected directly to a washing machine 18.

Valve-controllable outlet unit 10 is contained in housing 12. Housing 12 conceals the outlet unit 10, adding to the aesthetics when installed in a residence and protecting from inadvertent contact with a hot water portion of the unit. It should be noted that outlet unit 10 can be installed without housing 12 using brackets 13 placed across the unit and screwed into wall 14.

Outlet unit 10 has a first conduit 128 and collinear with a second conduit 228. First conduit 128 has input port 132 and output port 134. Second conduit 228 has input port 232 and output port 234. Ports 132, 134, 232 and 234 are oriented in substantially the same direction and are adapted to connect to hoses 140, 142, 240 and 242, respectively. The hoses are connected to the ports with mating threads or the like to provide a substantially leak-proof seal. The hoses are formed of a flexible material that allows ready connection of outlet unit 10 to water source 16 and washing machine 18. Such a material is cured rubber or the like. Ports 132, 134, 232 and 234 extend past a bottom surface plane 28 of housing 12 to facilitate connection of the hoses.

Figure 2:
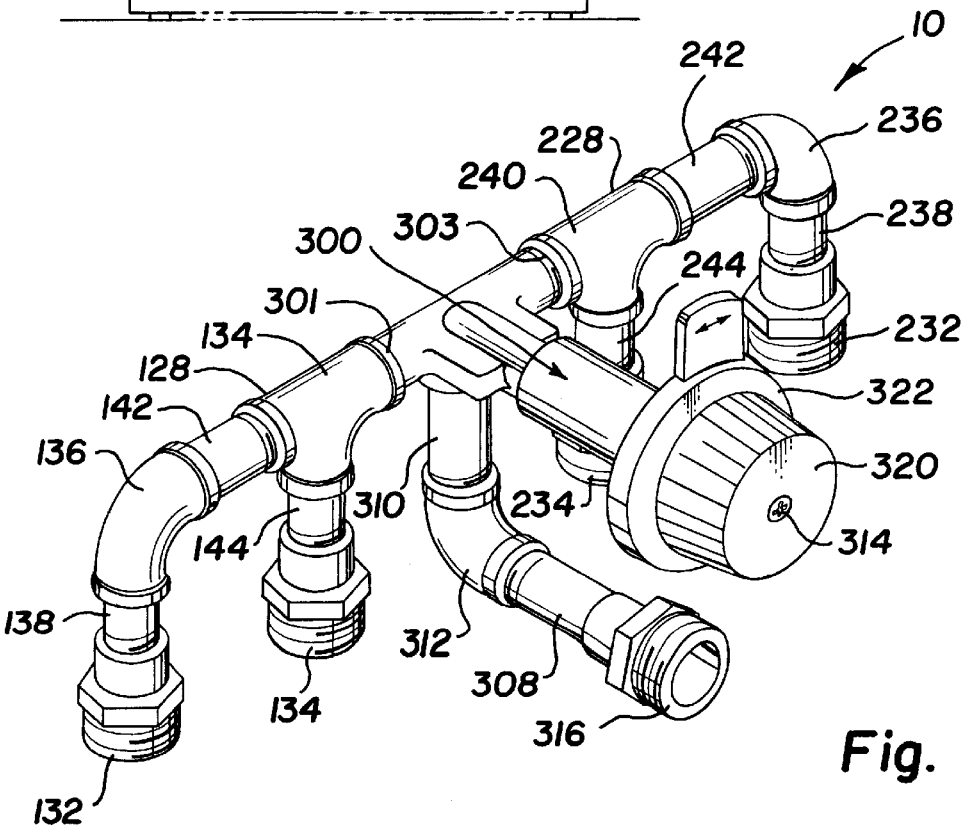
FIG. 2 is a perspective view of the invention.

Referring to FIG. 2, a perspective view illustrating outlet unit 10 in greater detail. For clarity, only first conduit 128 is discussed with the understanding that in this embodiment first conduit 128 is a substantial mirror-image of second conduit 228. But it is not necessary that outlet unit 10 be symmetrical to obtain the advantages of an in-line valve-controllable outlet.

Conduit 128 has first elbow connector 136 has a first end connected to input port 132 through a substantially straight first-port pipe member 138. A second end of first elbow pipe connector 136 is connected to a first end of pipe T-connector 140 through second pipe-port member 142. A second end of pipe T-connector 140 is connected to output port 134 through third pipe-port member 144. A third end of pipe T-connector 140 is connected to a first input port 301 of mixing valve 300.

Ports 132, 134, 232 and 234 are oriented in a generally downward direction to accommodate hoses 140, 142, 240 and 242 when outlet unit 10 is placed on supporting wall 14. The downward orientation limits torsional forces around the connections of the outlet unit 10 through brackets 13, as might otherwise be encountered with the embodiment shown in FIG. 5.

Figure 3:
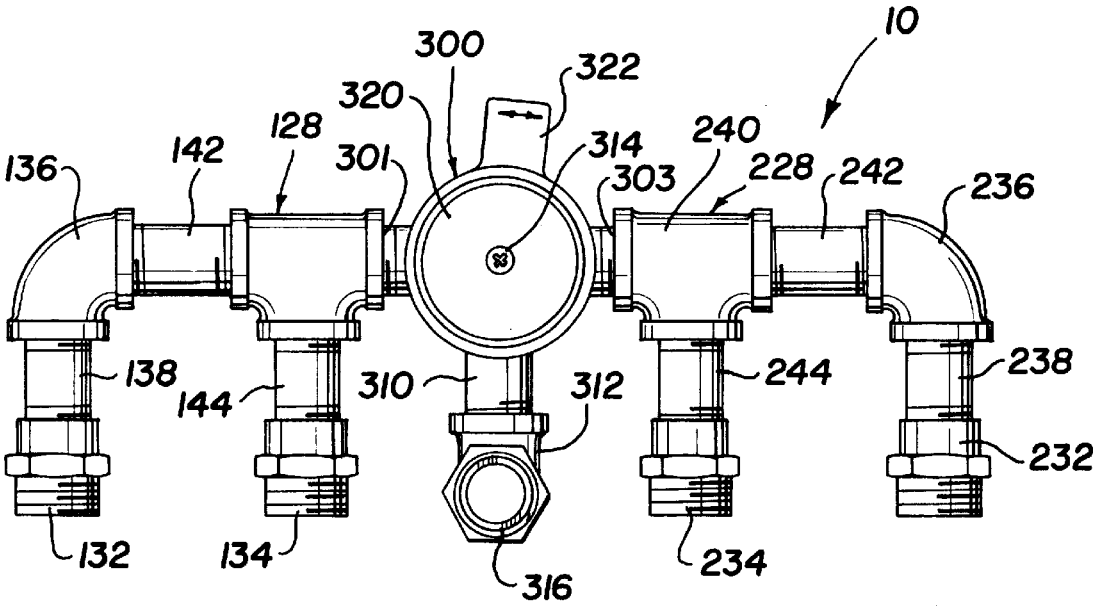
FIG. 3 is a top elevational view of the invention.
Figure 4:
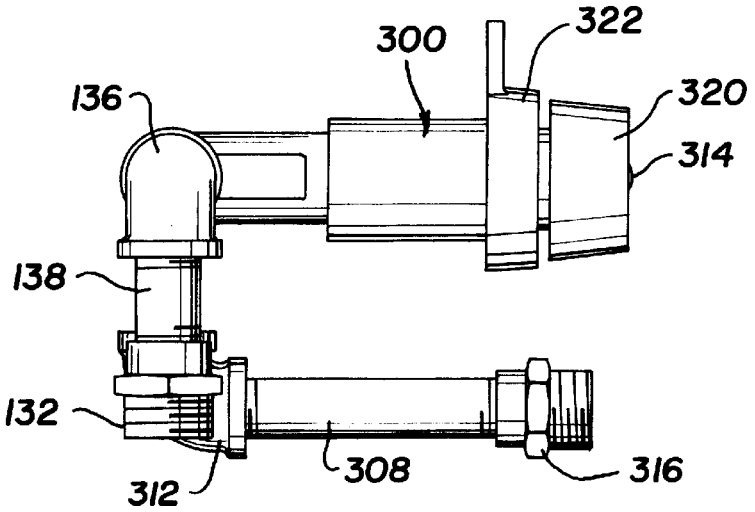
FIG. 4 is a side plan view of the invention.

Referring to FIGS. 3 and 4, mixing valve 300 has a first input port 302, a second input port 304 and an output port 306. Output port 306 is connected to a first end of auxiliary outlet pipe member 308 through pipe member 310 and pipe elbow 312. Elbow 312 orients outlet member 308 substantially parallel to valve control-knob axle 314, best shown in FIG. 4. A second end of auxiliary outlet member 308 is terminated in a pipe coupler 316 which can threadingly mate with a conventional water hose having a female thread adapter. Referring briefly to FIG. 1, coupler 316 and axle 314 extend past face surface 30 of housing 12. Control knob 318 is secured to control-knob axle 314 with screws or the like. Control-knob has a flow control member 320 and a hot-cold mixer member 322.

The outlet unit is made of a durable piping material for low-pressure fluid flow. Such a material is galvanized steel or PVC plastic or the like. PVC is preferred due to the lower cost and weight. Outlet unit 10 as discussed is composed of discrete pipe parts but can be formed of a unitary construction from a mold.

The outlet unit 10 is operated by placing a first port of a mixer valve in-line in fluid communication between the hot water source and the hot water inlet of the washing machine and placing a second port of the mixer valve in-line in fluid communication between the cold water source and the cold water inlet.

When hot-water faucet 20 and cold-water faucet 22 are in the "ON" position, fluid communication with outlet unit 10 and washing machine 18 results. When the mixer valve flow-control member 320 is in the "OFF" position—such that water does not flow to auxiliary outlet member 308—an uninterrupted flow is directed to the washing machine 18 for normal operation. When flow-control member 320 of outlet unit 10 is in the "ON" position, a mixed-water flow is discharged through auxiliary outlet member 308. Flow-control member 320 further controls the flow rate of water discharged through outlet member 308. When connected as shown in FIG. 1, first member 128 provides water from hot-water faucet 20 and second member 228 provides water from cold-water faucet 22. Hot-cold mixer member 322 of control knob 318 can adjust the mixture proportion supplied by first member 128 and second member 228 to obtain a desired water temperature. As noted above, a conventional water hose is connectable to the second end of auxiliary outlet member 308 through pipe coupler 316. The mixed water can be transported to an area where it can be used. For example, a pet can be washed outside with temperate or warm water without having to carry buckets of the water outside. If a vehicle is to be washed, the temperature of the water mixture can be increased at outlet unit 10 to soften oil-based build-up on the surface of the vehicle.

It should be noted that the water supply can be reversed to still achieve the spirit of the invention. That is, first member 128 can be connected to cold-water faucet 22 and second member 228 can be connected to second member 228. A water hose or other conduit can be connected to the auxiliary outlet member 308 to convey the mixed water to the desired location outside or inside the residence.

DESCRIPTION OF A SECOND EMBODIMENT

Figure 5:
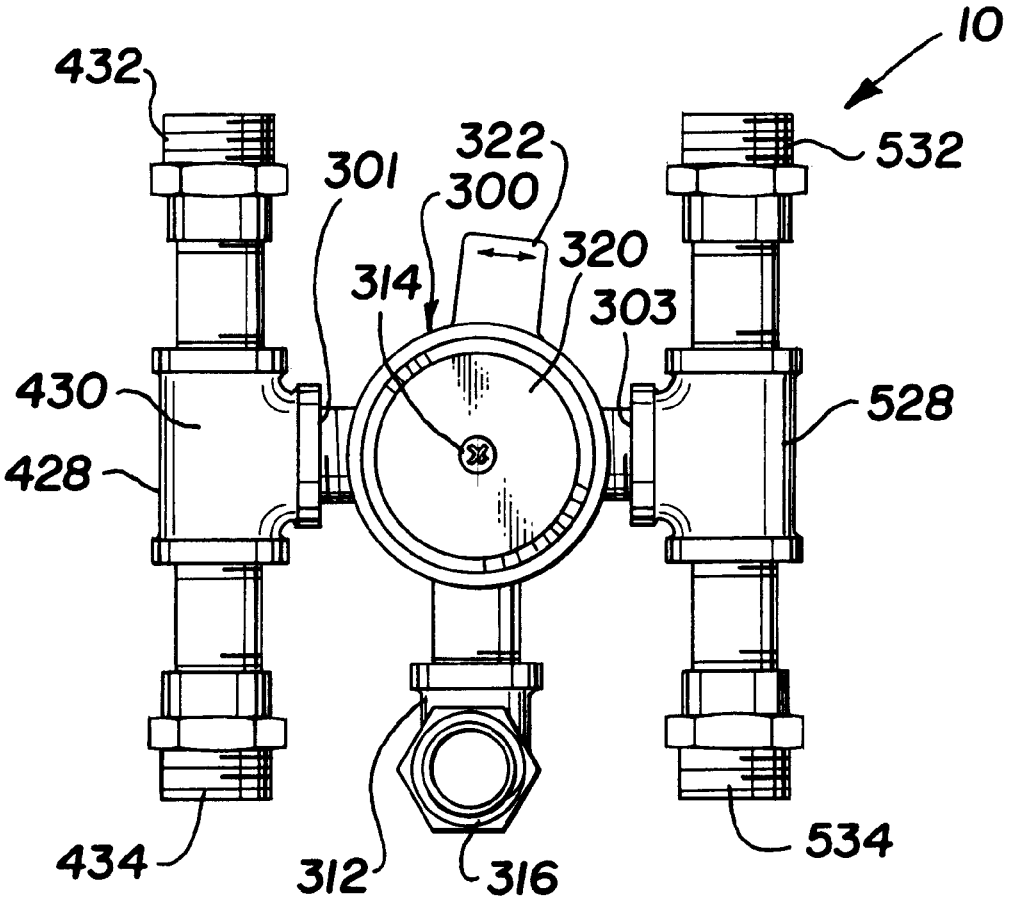
FIG. 5 is a top elevational view of a second embodiment of the invention.

Referring to FIG. 5, shown is a second embodiment of the outlet unit 10 having first conduit 428 and second conduit 528 with mixing valve 300 located substantially central in an H-configuration. As shown, first conduit 428 and second conduit 528 are substantially parallel. Connected to first port 301 of mixing valve 300 is a first port of T-connector 430. A second port of T-connector 430 is connected to input port 432. A third port of T-connector 430 is connected to output port 434. This configuration has less flow turbulence than the first embodiment, limiting accumulation of hard-water mineral deposits inside conduits 428 and 528 which may occur with the elbows 136 and 236 shown in FIGS. 2, 3 and 4.

The description and figures of the specific example above does not point out what an infringement would be, but are to provide at least one explanation of how to make and use the invention. Numerous modifications and variations of the preferred embodiments can be made without departing from the scope and spirit of the invention. Thus, the limits of the invention and the bounds of the patent protection are measured by and defined by the following claims:

Having described the invention, what is claimed is:

1. An in-line valve-controllable outlet for an in-line connection between a washing machine water supply and a washing machine, the water supply having a hot water source and a cold water source, the washing machine having a hot water inlet and a cold water inlet, the valve-controllable outlet comprising:

a first conduit having a first diversionary port positioned between an input port and an output port, the input port for connection to the hot water source and the output port for connection to the hot water inlet of the washing machine;

a second conduit having a second diversionary port positioned between an input port and an output port, the input port for connection to the cold water source and the output port for connection to the cold water inlet of the washing machine; and a mixing valve receiving each of the first and the second diversionary port, said mixing valve having an output port and controlling the rate of flow of water and the proportion of hot and cold water through the mixing valve output port.

2. The valve-controllable outlet of claim 1 further comprising:

an auxiliary outlet member having a first end connected to the output port of said mixing valve.

3. The valve-controllable outlet of claim 1 wherein said first and said second conduits are substantially collinear, the input and output ports of each said first and said second conduit oriented in substantially the same direction.

4. The valve-controllable outlet of claim 1 wherein said first and said second conduits are substantially parallel, the input port and the output ports of each said first and said second conduit are distal.

5. The valve-controllable outlet of claim 1 wherein said first and said second conduits are formed of galvanized steel.

6. The valve-controllable outlet of claim 1 wherein said first and said second conduits are formed of PVC plastic.

7. A method of providing an in-line mixable water source between a washing machine water supply and a washing machine, the water supply having a cold water source and a hot water source, the washing machine having a hot water inlet and a cold water inlet, the method comprising the steps of:

placing a first port of a mixer valve in fluid communication between the hot water source and the hot water inlet of the washing machine;

placing a second port of the mixer valve in fluid communication between the cold water source and the cold water inlet;

mixing the hot water source and the cold water source to form a mixed fluid of temperature controllable by the mixer valve; and discharging the mixed fluid from a third port of the mixer valve at a rate of flow controlled by the mixer valve.

8. The method of claim 7 wherein said step of placing a first port in fluid communication comprises the step of:

placing a first end of a conduit in fluid communication with the hot water source and a second end of the conduit in fluid communication with the hot water inlet.

9. The method of claim 7 wherein said step of placing a second port in fluid communication comprises the step of:

placing a first end of a conduit in fluid communication with the cold water source and a second end of the conduit in fluid communication with the cold water inlet.

10. The method of claim 7 wherein the mixed fluid is substantially composed of the cold water source.

11. An in-line valve-controllable outlet comprising:

a washing machine water supply having a hot water source and a cold water source;

a washing machine having a hot water inlet and a cold water inlet; and a mixing valve having a first input port, a second input port and a discharge port, the first input port being in fluid communication with said washing machine hot water inlet and said water supply hot water source, the second input port being in fluid communication with said washing machine cold water inlet and said water supply cold water source, the mixing valve controlling the rate of flow of water and the proportion of hot and cold water through the discharge port.

12. The valve-controllable outlet of claim 11 wherein said mixer valve comprises:

a flow control member; and a mixer member.

* * * * *